US006227696B1

(12) United States Patent
Duchnowski et al.

(10) Patent No.: US 6,227,696 B1
(45) Date of Patent: May 8, 2001

(54) RADIAL DIFFUSER

(75) Inventors: Frank A. Duchnowski, Lawrence, MA (US); Arthur E. LaCroix, Windham, NH (US)

(73) Assignee: J.H. Horne & Sons Company, Lawrence, MA (US)

( * ) Notice: Subject to any disclaimer, the term of this patent is extended or adjusted under 35 U.S.C. 154(b) by 0 days.

(21) Appl. No.: 09/282,798

(22) Filed: Mar. 31, 1999

(51) Int. Cl.[7] ..... B01F 5/06
(52) U.S. Cl. ..... 366/174.1; 366/336; 162/343
(58) Field of Search ..... 366/173.1, 173.2, 366/174.1, 181.5, 181.6, 336; 261/123; 454/305, 308; 162/57, 243, 336, 338, 343; 138/37, 39; 239/390, 391, 396, 548, 553, 553.5, 554, 555, 552, 567

(56) References Cited

U.S. PATENT DOCUMENTS

| | | | | |
|---|---|---|---|---|
| 3,296,066 | | 1/1967 | Green et al. . | |
| 3,563,852 | | 2/1971 | Rojecki . | |
| 3,640,843 | * | 2/1972 | Means | 162/343 |
| 3,817,689 | * | 6/1974 | Capy | 239/553 |
| 3,887,428 | | 6/1975 | Wahren et al. . | |
| 3,997,634 | * | 12/1976 | Downs . | |
| 4,024,016 | | 5/1977 | Gordon et al. . | |
| 5,015,335 | * | 5/1991 | Green | 162/243 |
| 5,316,383 | * | 5/1994 | Begemann et al. | 366/336 |
| 5,452,955 | * | 9/1995 | Lundstrom | 366/336 |
| 5,649,822 | * | 7/1997 | Gertler et al. | 239/553.5 |

* cited by examiner

*Primary Examiner*—Charles E. Cooley
(74) *Attorney, Agent, or Firm*—Pearson & Pearson, LLP; Walter F. Dawson

(57) ABSTRACT

A radial diffuser having insert rings for providing microturbulence to a paper fluid stock suspension and uniformly discharging the fluid stock via a plurality of tubes around the perimeter of the radial diffuser to a paper forming unit including a headbox. The radial diffuser comprises a cover, a main head body, an inlet feed pipe and a plurality of flexible or rigid circumferential discharge tubes. The main head body comprises either one or a pair of the co-axial ring inserts which form a fixed or variable passage or space in the chamber of the radial diffuser. The co-axial rings enhance fluid stock fiber mixing as the fluid stock flows through the radial diffuser head. The plurality of outlets around a side wall of the radial diffuser have removable housings for varying entrance coefficients to facilitate the pumping of the fluid stock suspension into the radial diffuser. Each of the outlets may be connected to a tube having a dilution line for controlling either manually or automatically the sheet basis weight profits.

18 Claims, 11 Drawing Sheets

RADIAL DIFFUSER

BACKGROUND OF THE INVENTION

1. Field of the Invention

This invention relates generally to paper making machinery and more particularly to an improved radial diffuser having insert rings for providing microturbulence to a receiving fluid stock suspension and uniformly discharging the same fluid stock suspension into circumferential discharge tubes disposed around the outside of the radial diffuser for feeding the inlets of a forming unit.

2. Description of Related Art

Competition and the constant demand to improve paper quality especially cross-direction (CD) basis weight profile has made many existing paper, board, tissue machine inlet distribution systems obsolete. Market volatility has forced many manufacturers to produce other new products on machines once exclusively reserved for the production of one or two established products.

New multi-product machine requirements have severely tasked the existing inlet stock flow distribution system on these existing machines. The flow rate process requirement of these machines make them unable to meet current market product quality standards.

A paper making machine has a paper fluid stock suspension that typically gets supplied to multiple inlets of a head box under conditions of uniform velocity and pressure for maximum uniformity of paper sheet formation. Various types of paper stock flow distributors have been used, but a common problem exists of not achieving equal distribution of the stock flow from the flow distributor multiple outlets to the inlets of the headbox.

For example, in U.S. Pat. No. 3,296,066, issued Nov. 13, 1963 to M. S. Green et al., a stock flow distributor is described comprising a header having an inlet end and the opposite end of the header is closed by a closure plate with a smooth inner surface extending normal to the axis of the header. The header is provided with multiple outlets in the side wall comprising short lengths of pipe, each of which is connected to an inlet pipe of the headbox. The entering flow of paper stock to the flow divider head has its velocity substantially extinguished by impingement against the closing plates, and this stock is then distributed among all the outlets and the lines leading to the headbox. However, experience with this distributor has shown that this flow distributor does not produce a stable jet of fluid into the sidewall outlets.

In U.S. Pat. No. 3,563,852, issued Feb. 16, 1971 to Walter E. Rojeski, a flow divider is described which is similar to the one disclosed in Green et al. U.S. Pat. No. 3,296,066.

The flow divider includes a generally cylindrical housing which has an axially extending inlet connected to the pump and a series of circumferentially spaced radially extending outlet tubes which are connected to a corresponding inlet tube on the body of a headbox. The housing includes an upper peripheral flange on which is mounted a semi-spherical or dome-shaped cover having a base flange secured to the flange by a series of bolts. A resilient thin rubber membrane or diaphragm is clamped between the flanges so that it is positioned adjacent the outlet tubes and normal to the stock flow. Air is supplied to the cover above the diaphragm. The air pressure supplied above the diaphragm is substantially equal to the stock pressure in the line from a pump so that the diaphragm is normally maintained in the generally flat position and deflects when a pulse is received. However, experience with the flow divider has shown that the stock flow to the outlet tubes is not uniform by not having a consistent pressure at each outlet tube.

A radial-flow distributor is described in a product description paper distributed by PAMA PAPIERMASCHINEN GmbH of Freiberg, Germany referred to as PAMA Information No. 1. The PAMA radial-flow distributor is described as providing an even distribution of a volume flow in a radial direction due to an exactly vertically directed flow on a polished circular impact plate. The radial-flow distributor achieves a wider range variety by changing the volume flow and consistency without negatively effecting the cross profile. It does not cause a separation of the suspension contents due to different density (i.e. no separation of fibers and ash). To ensure an undisturbed flow, the flow passage is described as being six-to-ten fold of the pipe diameter. The radially distributed volume flow is fed to the inlet chamber of a headbox by pipes and hoses. However, this radial-flow distributor does not have means for deflocking of stock suspension travelling through a section passage.

SUMMARY OF THE INVENTION

Accordingly, it is therefore an object of this invention to provide a radial diffuser in a paper machine to better control and enhance paper stock fluid suspension distribution through the T-shaped chamber of the radial diffuser.

It is another object of this invention to provide a radial diffuser having a cover and a main body with insert rings, a first insert ring fitted into the cover or impact plate, and a second insert ring fitted into the main body.

It is a further object of this invention to provide various types of surfaces on the insert rings forming an internal diffuser passage to enhance fluid stock fiber mixing when traveling through the chamber of the radial diffuser.

It is another object of this invention to provide removable outlet housing assemblies around the perimeter of the radial diffuser to provide variable entrance coefficients to facilitate the pumping of the fluid stock suspension into the radial diffuser.

It is yet another object of this invention to connect tubes having a ninety degree curvature to the outlets of the radial diffuser, each of the tubes comprises a dilution line means for providing controlled fluid flow to a forming unit.

These and other objects are further accomplished by a radial diffuser comprising a main body having a chamber for receiving and dispersing a fluid stock suspension, means in the center of the main body forming an inlet for connection to a source of the fluid stock suspension, a plurality of outlets arranged in uniformly spaced relationship around a side wall of the main body, the outlets being at substantially right angles to the direction of entering flow of the fluid stock suspension, a cover securely attached to the main body, and means removably positioned within the radial diffuser for providing a predetermined surface to enhance the fluid stock suspension flow after hitting the cover. The outlets are provided in removable housing assemblies to enable the outlets to have variable entrance coefficients. The predetermined surface means comprises an insert ring, disposed within a circular channel in the inside surface of the cover. The predetermined surface means comprises an insert ring disposed within a circular channel in the main body. The predetermined surface means includes a flat restrictor surface. The predetermined surface means includes a variable restrictor surface. The predetermined surface means creates a microturbulence within the chamber. Each of the outlets may be connected to a tube having a ninety degree curvature, and the tube comprises a dilution line means for providing controlled fluid stock flow to a forming unit.

The objects are further accomplished by a radial diffuser comprising a main body having a chamber for receiving and dispersing a fluid stock suspension, means in the center of the main body forming an inlet for connection to a source of the fluid stock suspension, a plurality of outlets arranged in uniformly spaced relationship around a side wall of the main body, the outlets being at substantially right angles to the direction of entering flow of the fluid stock suspension, a cover securely attached to the main body, a first insert ring disposed in the cover having a first predetermined surface, and a second insert ring disposed in the main body having a second predetermined surface. The outlets are provided in removable housing assemblies to enable the outlets to have variable entrance coefficients. The first insert ring and the second insert ring being disposed opposite each other to create a microturbulence within the chamber. The first predetermined surface and the second predetermined surface comprises a fixed or a variable restrictor surface. The outlets connect to a straight tube or a tube having a ninety degree curvature, and the curved tube comprises a dilution line means for providing controlled fluid flow to a forming unit.

The objects are further accomplished by a method of providing a radius diffuser comprises the steps of providing a main body having a chamber for receiving and dispensing a fluid stock suspension, forming an inlet for connection to a source of the fluid stock suspension in the center of the main body, arranging a plurality of outlets in uniformly spaced relationship around a side wall of the main body, positioning the outlets at substantially right angles to the direction of flow of the entering fluid stock suspension, attaching a cover securely to the main body, and positioning a means having a predetermined surface within the radial diffuser for enhancing the fluid stock suspension flow after hitting the cover. The step of providing a plurality of the outlets comprises the step of providing the outlets in removable housing assemblies to enable the outlets to have variable entrance coefficients. The step of positioning the means having a predetermined surface comprises the step of providing a first insert ring within a first circular channel. The step of positioning the means having a predetermined surface comprises the step of providing a second insert ring within a second circular channel opposite the first circular channel.

The objects are further accomplished by a method of providing microturbulence to a fluid stock suspension in a radial diffuser comprising the steps of providing a main body having a chamber in the radial diffuser for receiving and dispersing the fluid stock suspension, forming an inlet for connection to a source of the fluid stock suspension in the center of the main body, arranging a plurality of outlets in uniformly spaced relationship around a side wall of the main body, providing the outlets at substantially right angles to the direction of flow of the entering fluid stock suspension, attaching a cover securely to the main body, disposing in the cover a first insert ring having a first predetermined surface, and disposing in the main body a second insert ring having a second predetermined surface. The step of providing a plurality of the outlets comprises the step of providing the outlets in removable housing assemblies to enable the outlets to have variable entrance coefficients. The method comprises the steps of connecting a tube having a ninety degree curvature to each of the outlets, and feeding a dilution line means into the tube to provide controlled fluid control to a forming unit.

Additional objects, features and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENT

Figure 1:
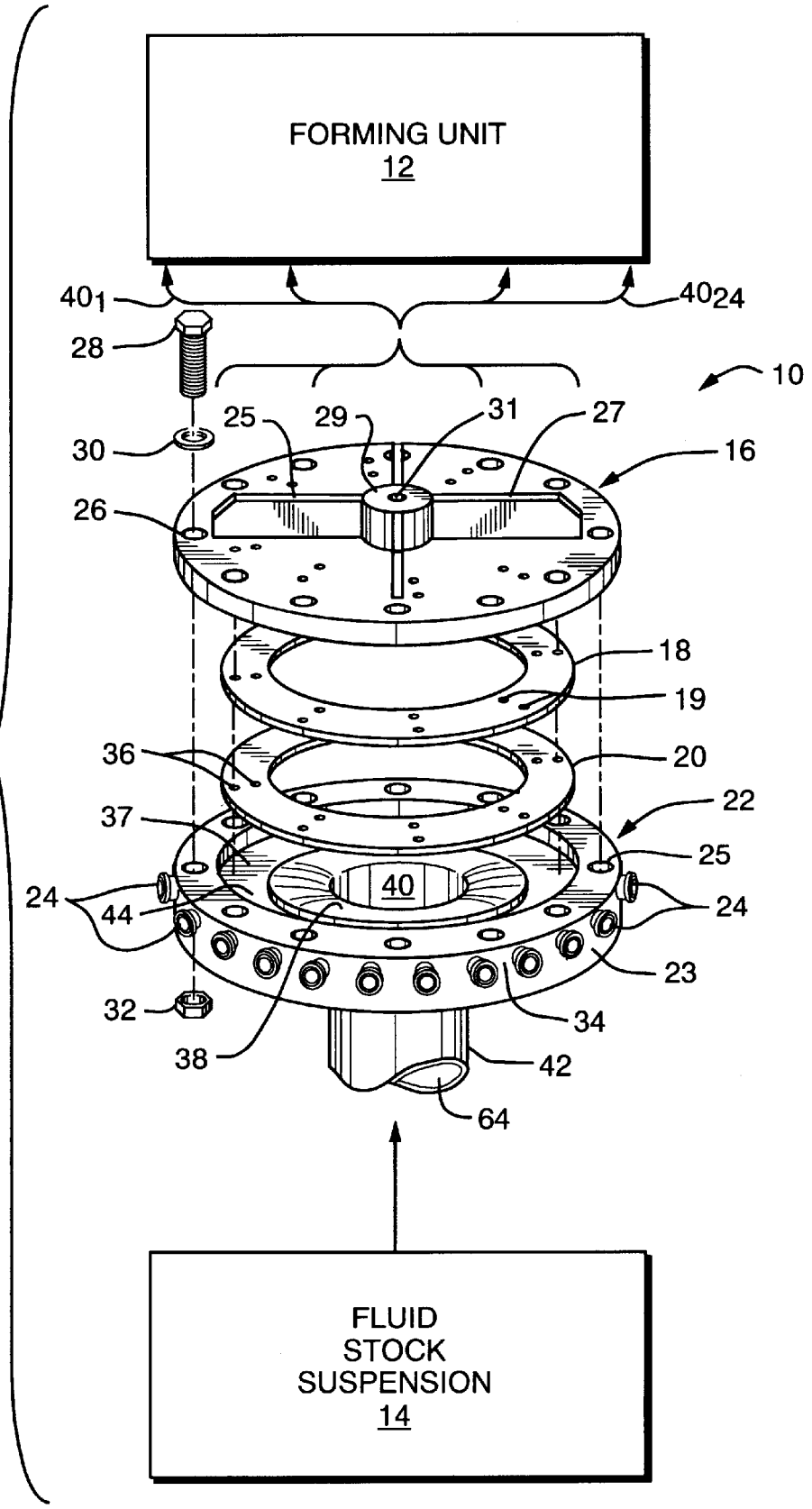
FIG. 1 is an exploded perspective view of a radial diffuser showing two insert rings, a first ring disposed in a channel of the cover or impact plate and a second ring disposed in a channel of the main body, and further showing the chamber wherein paper fluid stock enters from the bottom and exits the radial diffuser via a plurality of outlets connected via flexible tubes to a forming unit.

Referring to FIG. 1, an exploded perspective view of the invention is shown comprising an impact type radial diffuser 10 having a pair of insert rings 18, 20 which form a fixed or variable passage or space for providing microturbulence to a fluid stock suspension 14 flowing into a T-shaped chamber 64.

The radial diffuser 10 comprises a cover 16, a main body 22, an inlet feed pipe 42 and a plurality of discharge tubes or outlets 24 disposed around a side wall 23 of the main body 22. The main body 22 comprises a co-axial channel 44 surrounding the inlet pipe opening 40. The insert ring 20 is secured within the channel 44 by screws (not shown) in holes 36. Insert ring 18 is secured within a similar channel in the bottom flat surface of the cover 16.

Figure 4:
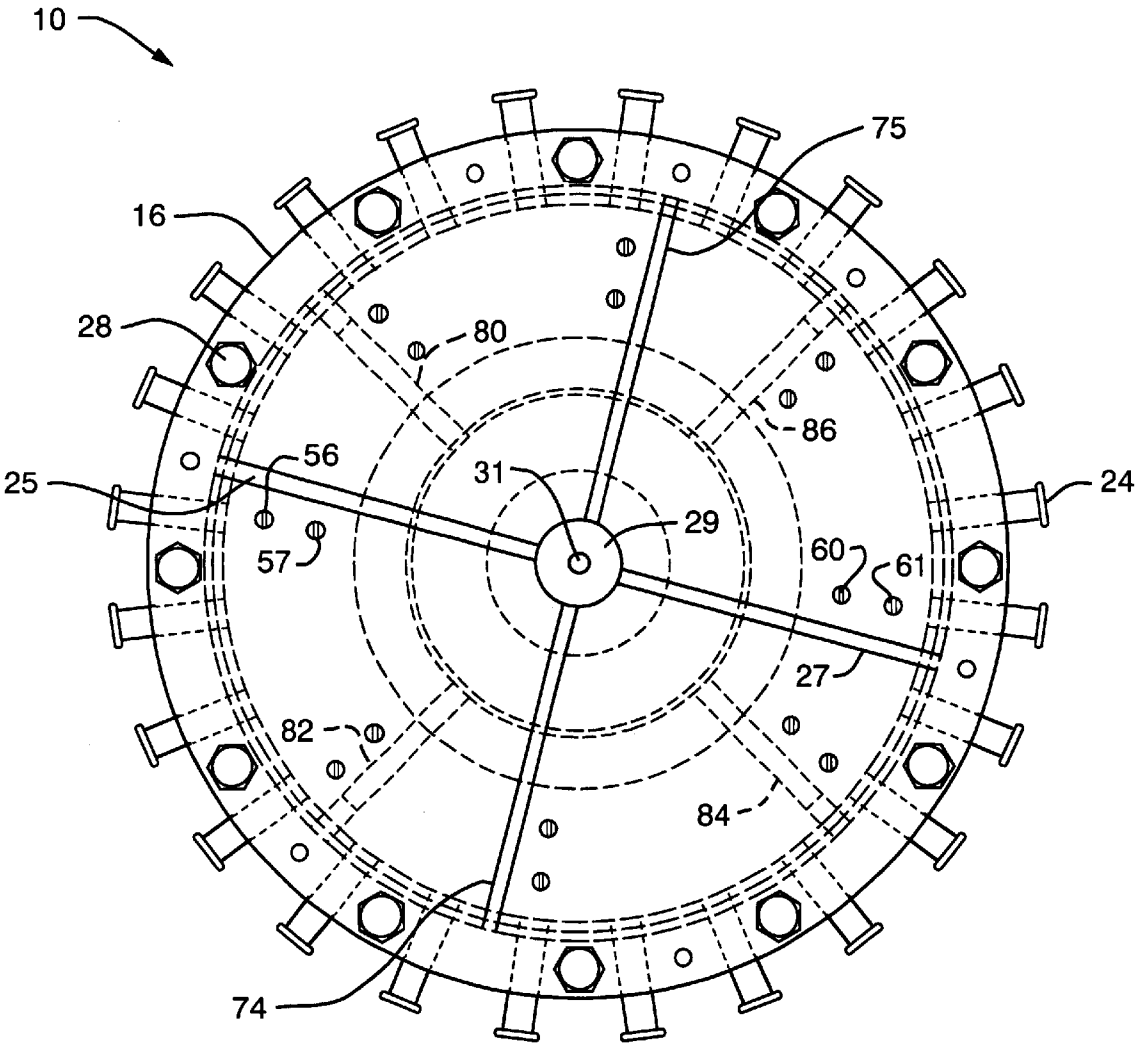
FIG. 4 is a top view of the radial diffuser showing a ribbed cover with a center post for lifting the cover and showing with dashed lines a rib structure under the main body.

Referring to FIG. 1 and FIG. 4, FIG. 4 is a top view of the radial diffuser 10 showing the cover 16. The cover 16 is secured to the main body 22 by a plurality of the combination of bolt 28, washer 30 and nut 32. There are a total of twelve such bolt combinations equally spaced around the circumference of the cover 16 and main body 22 as shown in FIG. 4. The top of the cover 16 comprises four (4) equally spaced ribs 25, 27, 74, 75 extending radially from a center cylinder 29 having a tapped hole 31 to facilitate lifting the cover 16 off the main body 22. The insert ring 18 is secured in the cover 12 by equally spaced pairs of machine screws such as pairs 56, 57, and 60, 61 around the top surface of the cover 12. The cover 12 serves as an impact plate for deflecting the fluid stock suspension 14 flow.

When the fluid stock suspension 14 is received through the pipe 42 under proper conditions of volumetric flow and pressure as determined by the desired operation conditions, for example, of a paper machine, it hits or impinges against the flat impact cover 16 whereby its velocity is substantially extinguished.

The impact turns the fluid stock suspension 14 ninety degrees symmetrically in all directions without disintegrating or rebounding back. The fluid stock suspension 14 divides itself into equal value discrete streamline mini-jet sections lining up exactly in number to feed into the plurality of outlet tubes 24 which are equally spaced around the side wall 23 of the main body 22. The radial diffuser's inherent feature, to exactly divide into mini-jet sections (without friction and energy losses) and to develop the sources uniform discharge feed pressure at the entrance to each tube 24, eliminates the need for costly, highly emperical inlet profile calculation and expensive inlet manufacturing construction procedures.

Therefore, the radial diffuser 10 is a very efficient and simple means of taking flow from a round pipe 42 and with minimum effort changing its direction and spreading the flow across a paper/board forming unit 12. This results in a minimum final sheet basis weight profile deviation at the reel.

Still referring to FIG. 1 and FIG. 4, the main body 22 comprises the plurality of discharge tubes or outlets 24 substantially at right angles to the direction of entering flow of the fluid stock suspension 14 and disposed in uniformly spaced relationship around the side wall 23 of the main body 22. The radial diffuser 10 comprises a rib structure underneath the main body comprising reinforcing ribs 80, 82, 84, 86 which are shown by dashed lines in FIG. 4.

Figure 2:
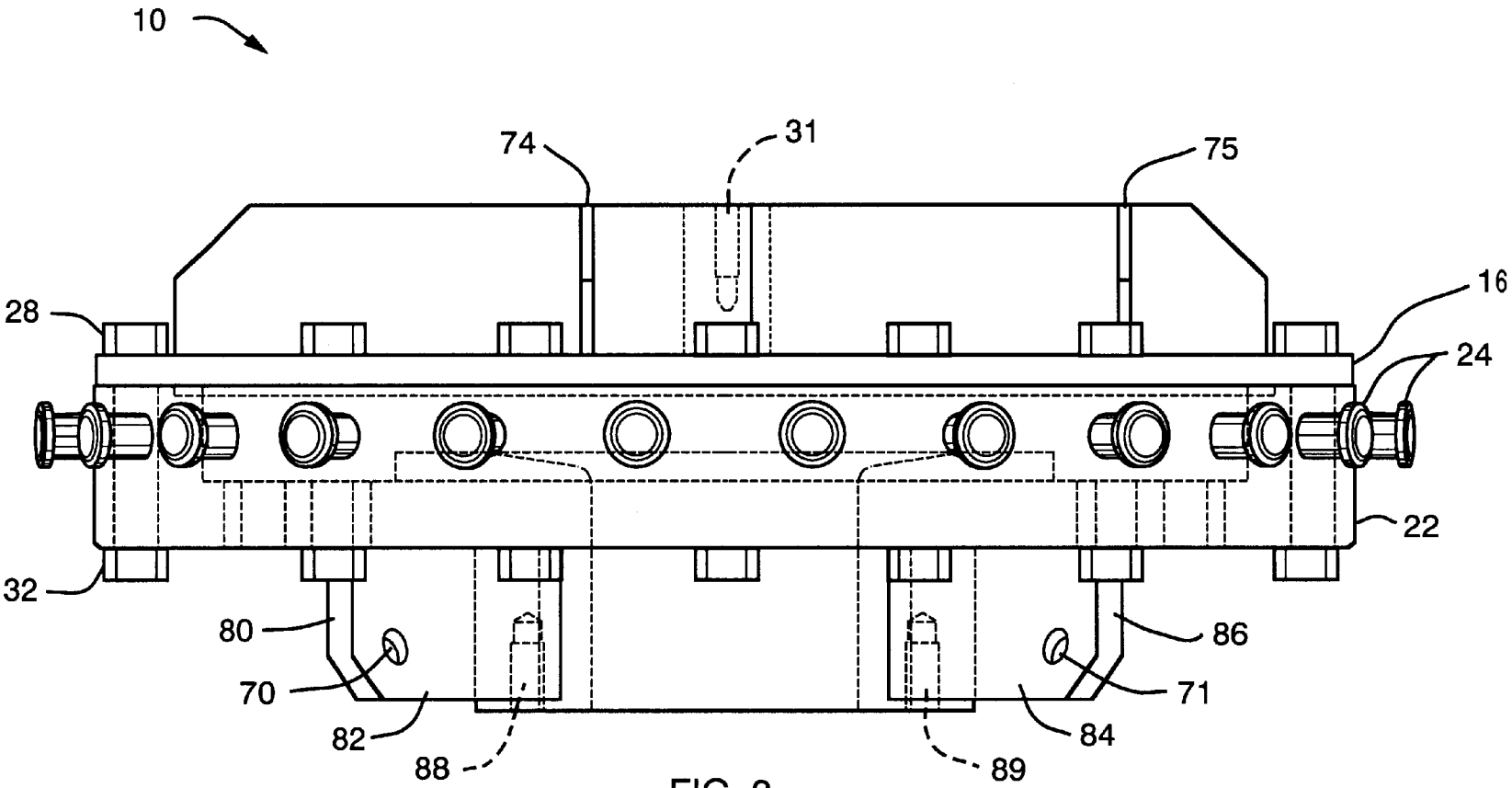
FIG. 2 is a front elevational view of the radial diffuser showing a plurality of quick disconnect outlets around the circumference of a side wall of the main body and supporting ribs on the cover and below the main body.

Referring now to FIG. 2, a front elevational view of the radial diffuser 10 is shown with the cover 16 bolted to the main body 22 and showing the rib support structure 80, 82, 84, 86 underneath the radial diffuser 10 for attaching to fabricated steel supports (not shown). Holes 70 and 71 in ribs 82, 84 provide means for securing the main body 22, and tapped holes 88, 89 are provided for insertion of bolts (not shown) to further provide for attachment of the radial diffuser to the fabricated steel supports.

Figure 3:
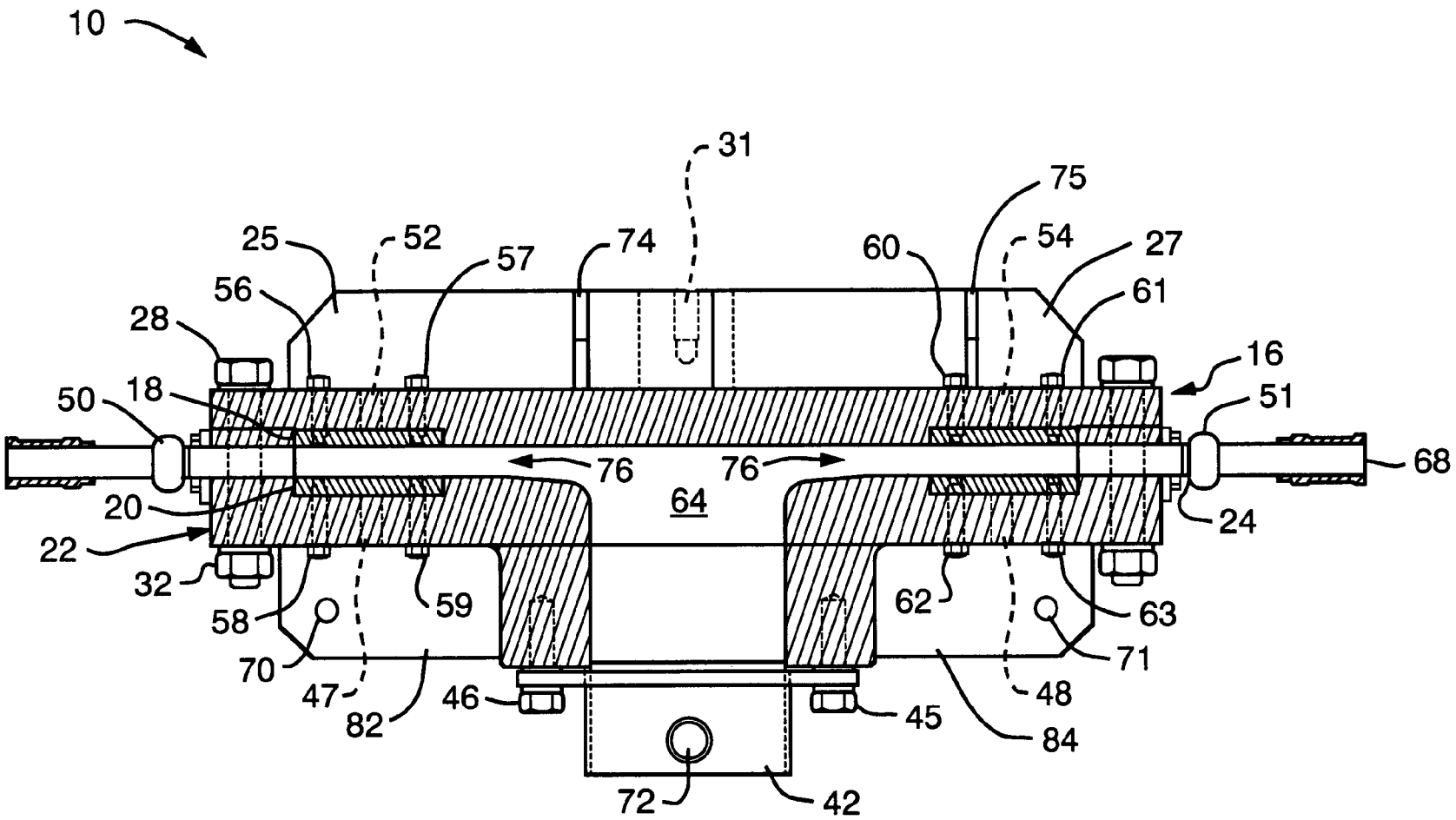
FIG. 3 is a front elevational cross section of the radial diffuser with straight outlet connections extending from around the perimeter of the main body showing the upper and lower insert rings and the "T" chamber for the flow of paper fluid stock.
Figure 5A:
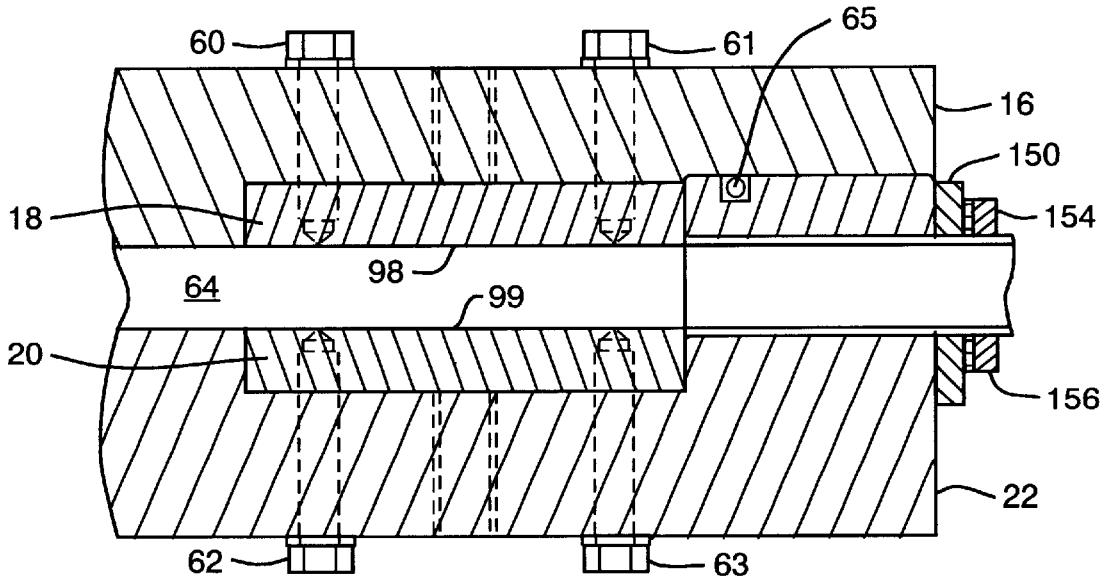
FIG. 5A is a cross-sectional view of a portion of the radial diffuser showing the insert rings having a plain surface embodiment.

Referring to FIG. 3, a front elevational cross section of the radial diffuser 10 shows a fixed space or passage 76 in the T-shaped chamber 64 between the plain insert rings 18, 20 for minimal effect on fluid stock suspension 14 flowing through the chamber 64. Two outlets 24 are shown (from a total of twenty-four) on each side of the main body 22 with straight tubes 50, 51 connected thereto. When it is desired to provide a microturbulence to a fluid stock suspension 14 flowing into chamber 40 and after striking the cover 12, the plain or flat insert rings 18, 20 also shown in FIG. 5A are removed and replaced with rings having anyone of a plurality of different surface configurations as illustrated in FIGS. 5B to 5I. The upper ring 18 is secured to the cover 12 by a plurality of pairs of machine screws equally spaced around the top of the cover 12 and protruding into the ring 18 as illustrated by machine screws 56, 57, and 60, 61. The lower ring 20 is secured to the main body 22 by a plurality of pairs of machine screws 58, 59 and 62, 63 equally spaced around the bottom surface of the main body 22 and protruding into insert ring 22. The elements of the radial diffuser 10 including the cover 12, insert rings 18, 20, main body 22 and outlets 24 are made of stainless steel.

Referring now to FIGS. 5A to 5I, each of these figures shows a cross-sectional view of a portion of the radial diffuser 10 and in particularly an alternate embodiment restrictor surface of a side of each insert ring 18, 20 facing the passage way 64. FIG. 5A shows plain or smooth surfaces 98, 99 when there is no need to provide a microturbulence to the fluid stock suspension 14 flowing through the passageway 64. FIGS. 5A to 5I show some of the plurality of machine screws 60, 61, 62, 63 that secure the upper and lower insert rings 18, 20 and also show O-ring seal 65 positioned in the main body of the radial diffuser 10.

FIGS. 5B to 5I show cross-sectional views of the plurality of restrictor surfaces for creating a microturbulence in passage 64 for various mixtures of fluid stock suspension 14. The surfaces of insert rings 18, 20 for each of the figures have different configurations to enhance fluid stock fiber mixing traveling through the radial diffuser 10, and one of ordinary skill in the art will recognize that there are other configurations of the surfaces (not shown) of the insert rings 18, 20 that may be more suitable for a particular fluid stock suspension 14 to enhance fluid stock fiber mixing when traveling through the radial diffuser 10. Therefore, the surfaces of the insert rings 18, 20 in FIGS. 5A to 5I are not limited to the configurations shown. These removable rings 18, 20 can be configured to alter the radial diffuser's normal parabolic shaped pressure curve, known as Barlow's curve, thereby influencing the fluid stock flow by better control and enhanced flow distribution through the radial diffuser 10.

Figure 5B:
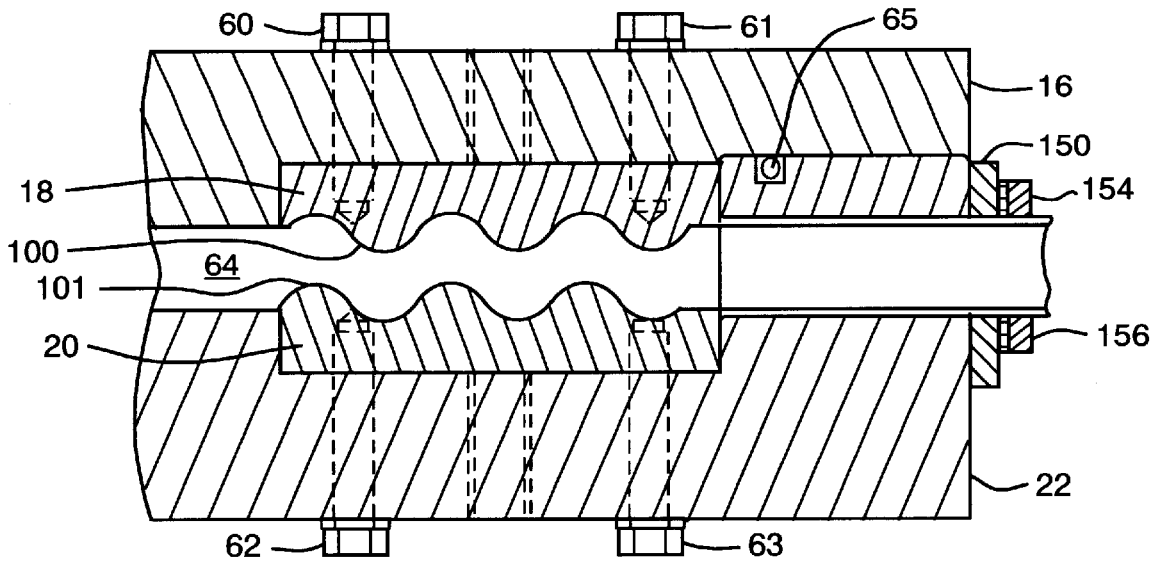
FIG. 5B is a cross-sectional view of a portion of the radial diffuser showing the insert rings having a sine wave surface embodiment.
Figure 5C:
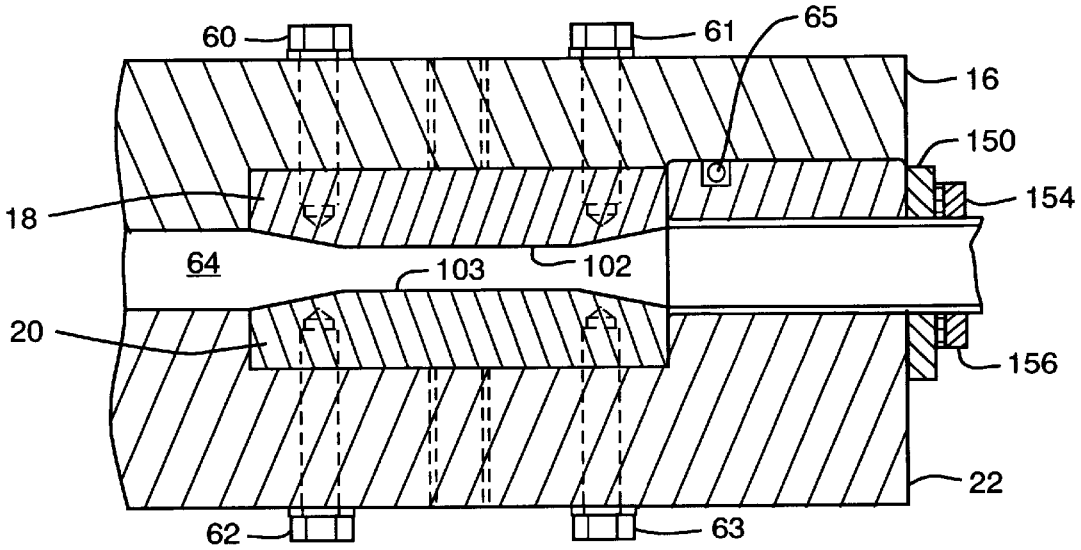
FIG. 5C is a cross-sectional view of a portion of the radial diffuser showing the insert rings having a venturi effect surface embodiment.
Figure 5D:
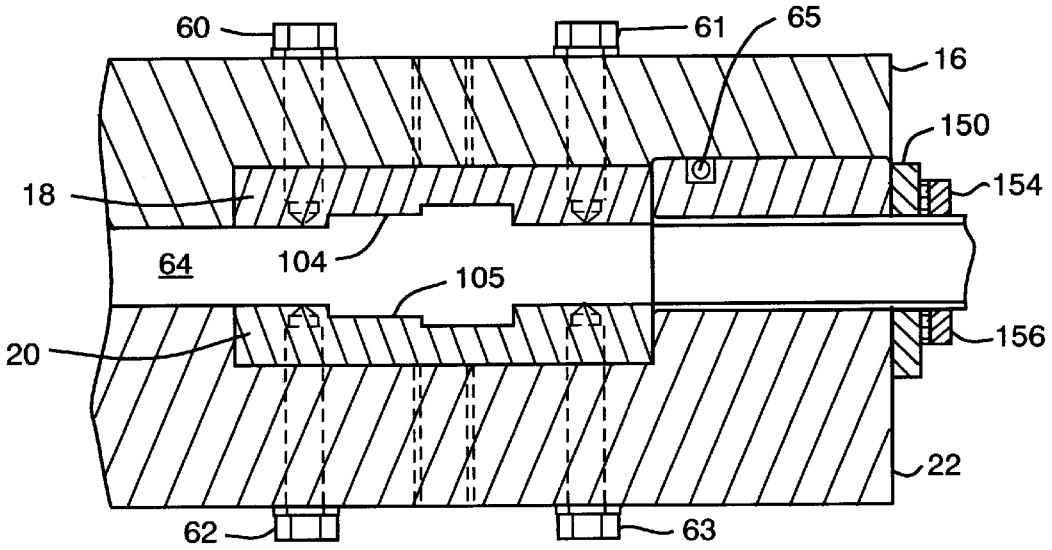
FIG. 5D is a cross-sectional view of a portion of the radial diffuser showing the insert rings having a diffuser surface embodiment.
Figure 5E:
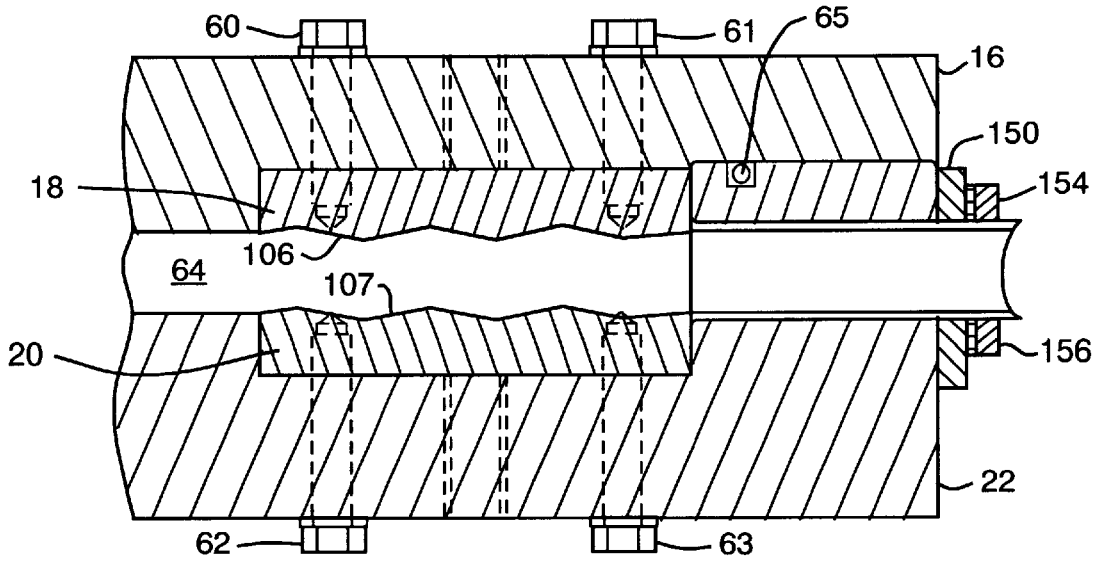
FIG. 5E is a cross-sectional view of a portion of the radial diffuser showing the insert rings having a corrugated surface embodiment.
Figure 5F:
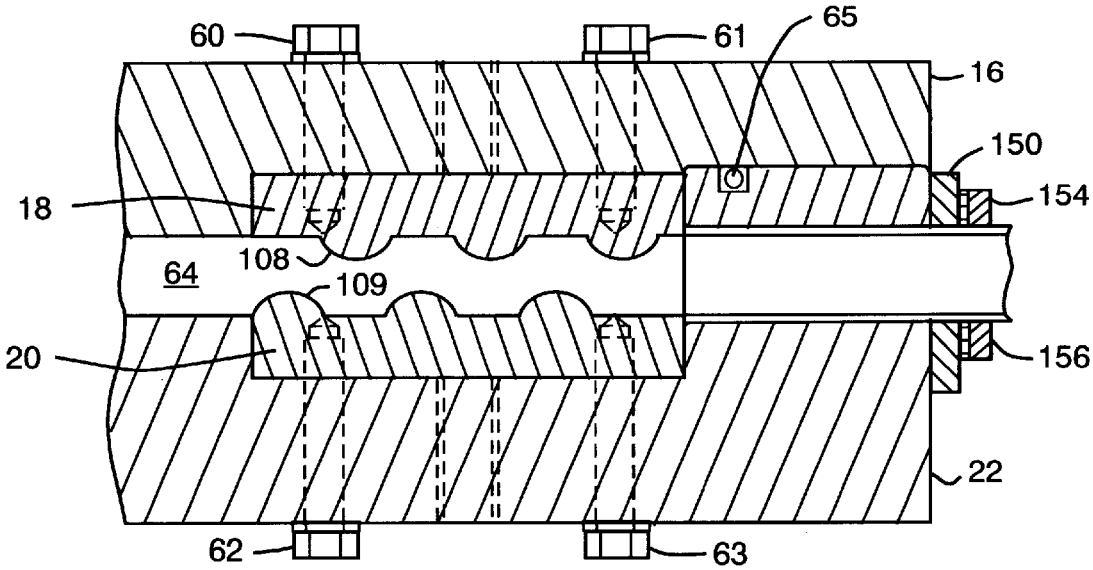
FIG. 5F is a cross-sectional view of a portion of the radial diffuser showing the insert rings having a half-moon surface embodiment.
Figure 5G:
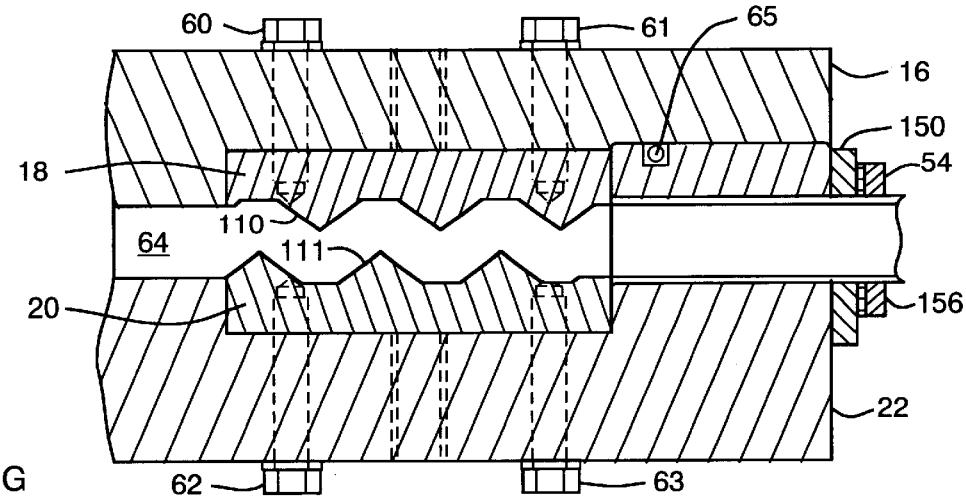
FIG. 5G is a cross-sectional view of a portion of the radial diffuser showing the insert rings having a serrated surface embodiment.
Figure 5H:
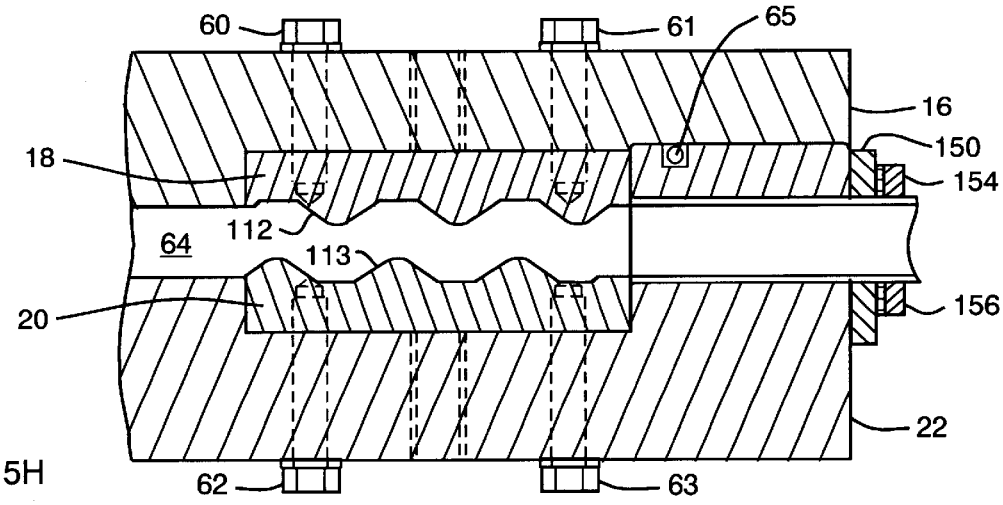
FIG. 5H is a cross-sectional view of a portion of the radial diffuser showing the insert rings having a wave surface embodiment.
Figure 5I:
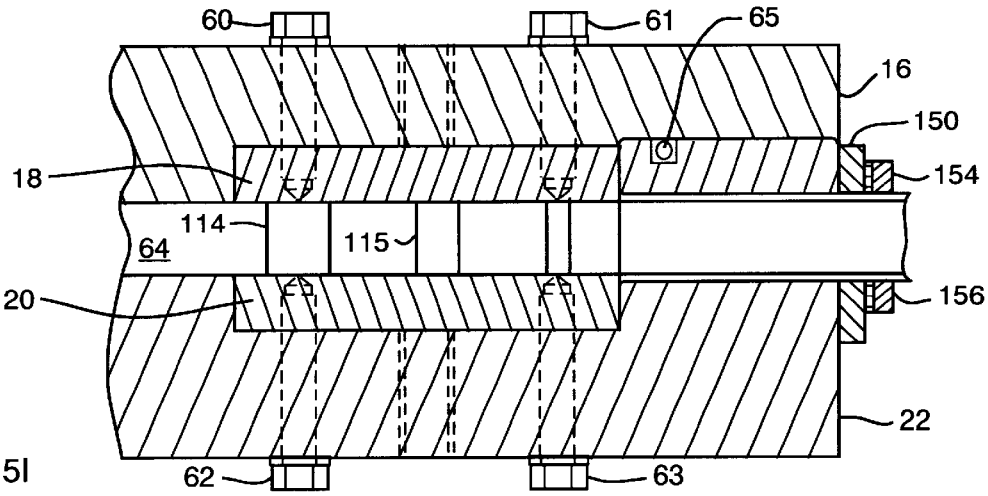
FIG. 5I is a cross-sectional view of a portion of the radial diffuser showing the ring inserts having a post surface embodiment.

FIG. 5B shows sine wave surfaces 100, 101 for the insert rings 18, 20. FIG. 5C shows venturi effect surfaces 102, 103. FIG. 5D shows diffuser surfaces 104, 105. FIG. 5E shows corrugated surfaces 106, 107. FIG. 5F shows half-moon surfaces 108, 109. FIG. 5G shows serrated surfaces 110, 111. FIG. 5H shows wave surfaces 112, 113. FIG. 5I shows post surfaces 114, 115. The particular surface to be used for the inset rings 18, 20 in a specific application is determined emperically.

Figure 6A:
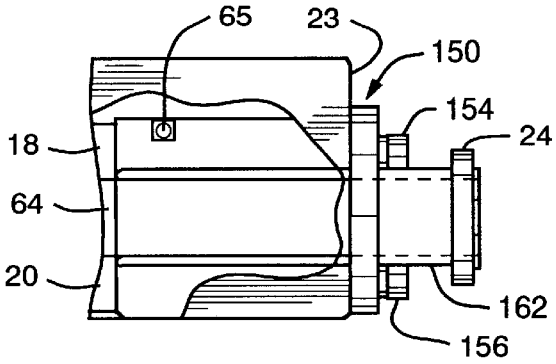
FIG. 6A is a cut-away view of an embodiment of an outlet housing assembly having a round stem for the outlets around the perimeter of the radial diffuser.
Figure 6B:
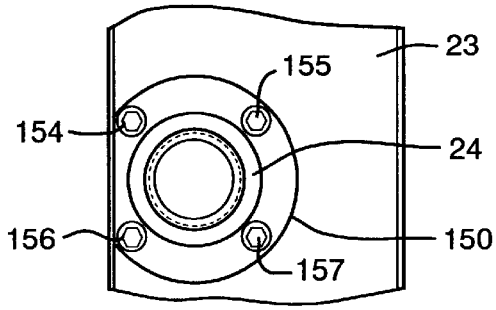
FIG. 6B is a front view of the embodiment of the outlet housing assembly of FIG. 6A having a round stem showing a connector and the machine screws for attaching the assembly to the side wall of a radial diffuser.

Referring now to FIGS. 6A and 6B, FIG. 6A is a cut-away view of an embodiment of a removable outlet housing assembly 150 having a round stem at the entrance adjacent to the chamber 64 of the radial diffuser 10. FIG. 6B is a front view of the outlet housing assembly 150 of FIG. 6A showing the machine screws 154 to 157 for attaching the outlet housing assembly 150 to the side wall 23 of the radial diffuser 10.

Figure 7A:
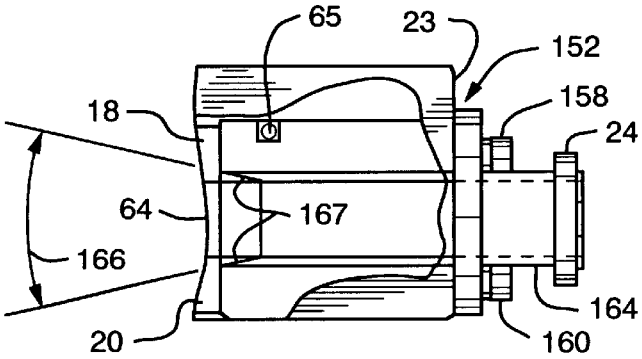
FIG. 7A is a cut-away view of an alternate embodiment of an outlet housing assembly having a flared end stem for the outlets around the perimeter of the radial diffuser.
Figure 7B:
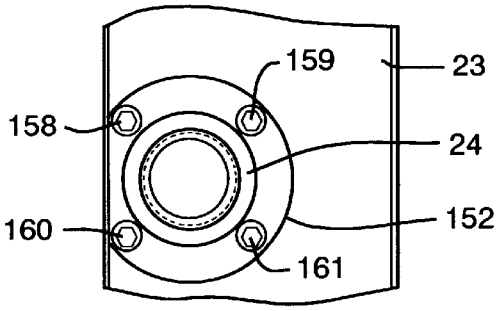
FIG. 7B is a front view of an alternate embodiment of an outlet housing assembly of FIG. 7A showing a connector and the machine screws for attaching the assembly to a radial diffuser.

Referring now to FIGS. 7A and 7B, FIG. 7A is a cut-away view of an alternate embodiment of the removable outlet housing assembly 152 having a flared end stem 167 at the entrance adjacent to the chamber 64 of the radial diffuser 10. FIG. 7B is a front view of the outlet housing assembly 152 of FIG. 7A showing the machine screws 158–161 for attaching the outlet housing assembly 152 to side wall 23 of the radial diffuser 10. The flared-end stem 167 provides for altering the entrance coefficient and making it easier for a pump (not shown) to pump the fluid stock suspension 14 into the radial diffuser 10 via pipe 42. The flare angle 166 is approximately twenty degrees. The entrance coefficient of the removable outlet housing assembly 150, 152 can be altered from 0.05 to 0.5 depending on the flow requirements into the hoses.

Figure 8A:
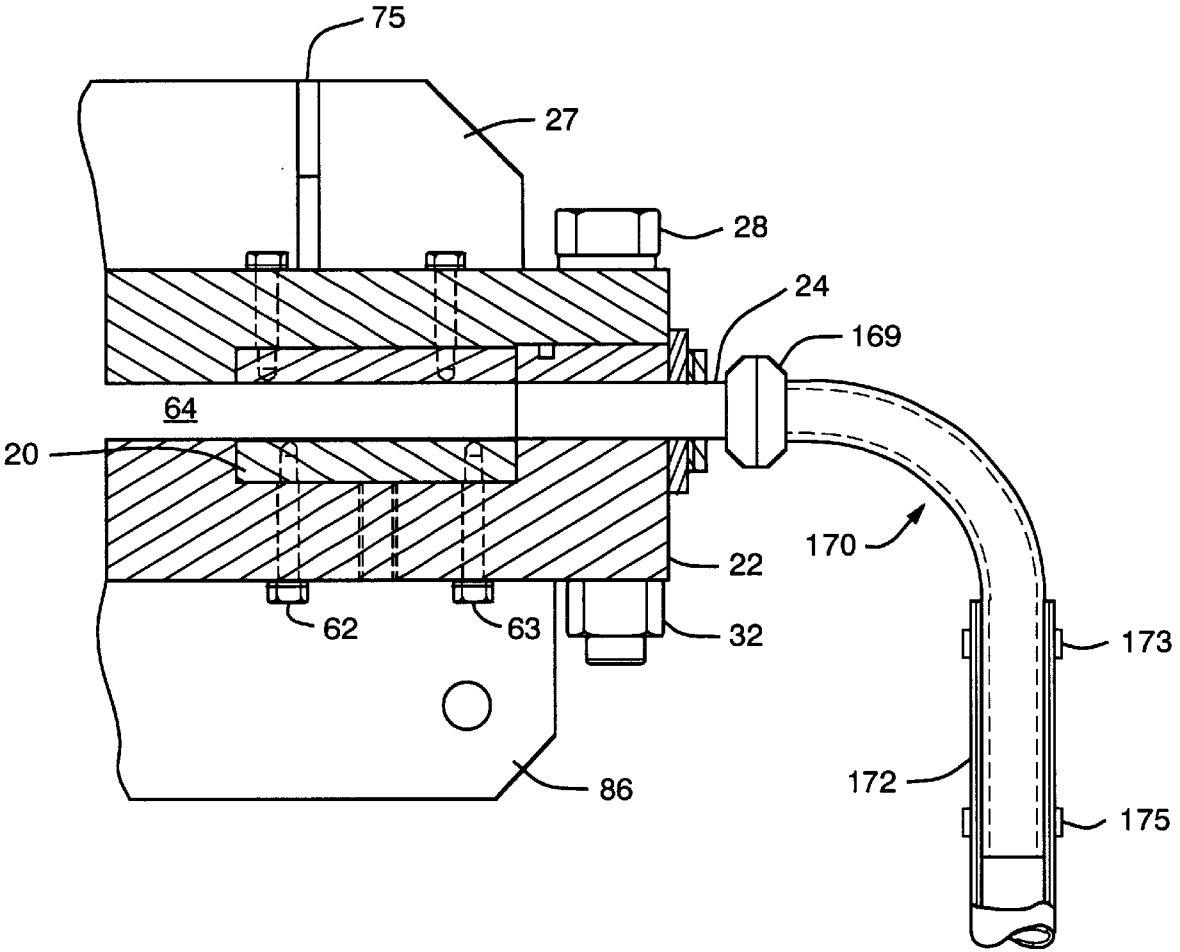
FIG. 8A is a cross-sectional view of an outlet housing assembly having a ninety degree curved tube connected to its outlet and a hose attached to the other end of the curved tube.
Figure 8B:
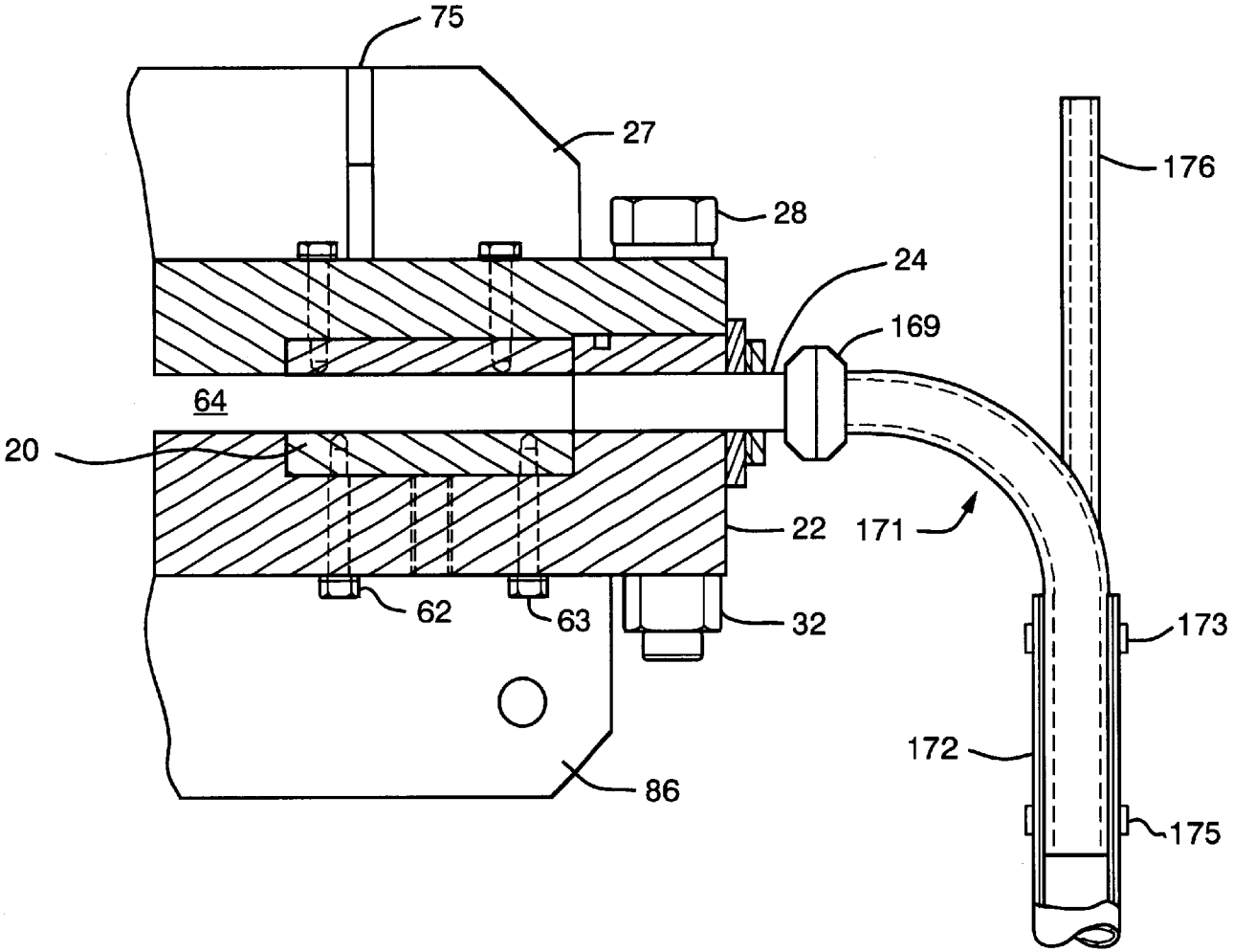
FIG. 8B is a cross-sectional view of a housing assembly having a ninety degree curved tube connected to its outlet and showing a mini-dilution line connection extending upward opposite to the direction of the curved tube.

Referring to FIGS. 8A and 8B, FIG. 8A shows a cross-sectional view of an outlet housing assembly 24 having one end 169 of a ninety degree curved tube 170 connected to the outlet portion of the housing assembly 24. The other end of the curved tube 170 is inserted within the opening of a flexible hose 172 and hose clamps 173, 175 secure the hose to the curved tube 170. FIG. 8B shows a cross-sectional view of the outlet housing assembly 24 having a ninety-degree curved tube 171 connected to the outlet portion of the housing assembly 24, and also having a mini-dilution line 176 extending upward opposite to the direction of the curved tube 171. The mini-dilution line 176 provides controlled fluid flow into a plurality of main tube hoses $\mathbf{40}_1$, to $\mathbf{40}_{24}$ which connect to the forming unit 12. This mini-dilution feature allows for manual or automatic sheet basis weight profile control.

Dilution control reduces the tendency of a sheet to curl when discharging onto a forming table in a paper machine due to standard type mechanical slice opening control. It also is used to correct or reduce uneven edge/center basis weight profile development during drying on certain grades of sheet furnish. Dilution control reduces the need for standard adjusting type mechanical slice tip bending opening sheet basis weight profile control.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. A radial diffuser comprising:

a main body having a chamber for receiving and dispersing a fluid stock suspension;

means in the center of said main body for forming an inlet for connection to a source of said fluid stock suspension;

a plurality of outlets arranged in uniformly spaced relationship around a side wall of said main body;

said outlets being at substantially right angles to the direction of entering flow of said fluid stock suspension;

a cover having a flat area for impacting of said fluid stock suspension securely attached to said main body;

means, removably positioned within said radial diffuser, for providing a predetermined surface to enhance said fluid stock suspension flow after impacting said cover; and said predetermined surface means comprises an insert ring disposed within a circular channel in the inside surface of said cover.

2. The radial diffuser as recited in claim 1 wherein said outlets are provided in removable housing assemblies to enable said outlets to have variable entrance coefficients.

3. The radial diffuser as recited in claim 1 wherein:

said predetermined surface means comprises an insert ring disposed within a circular channel in said main body.

4. The radial diffuser as recited in claim 1 wherein said predetermined surface means includes a flat restrictor surface.

5. The radial diffuser as recited in claim 1 wherein said predetermined surface means includes a variable restrictor surface.

6. The radial diffuser as recited in claim 5 wherein said predetermined surface means creates a microturbulence within said chamber.

7. The radial diffuser as recited in claim 1 wherein:

each of said outlets connect to a tube having a ninety degree curvature; and said tube comprises a dilution line means for providing controlled fluid stock flow to a forming unit.

8. A radial diffuser comprising:

a main body having a chamber for receiving and dispersing a fluid stock suspension;

means in the center of said main body forming an inlet for connection to a source of said fluid stock suspension;

a plurality of outlets arranged in uniformly spaced relationship around a side wall of said main body;

said outlets being at substantially right angles to the direction of entering flow of said fluid stock suspension;

a cover securely attached to said main body;

a first insert ring disposed in said cover having a first predetermined surface; and a second insert ring disposed in said main body having a second predetermined surface.

9. The radial diffuser as recited in claim 8 wherein said outlets are provided in removable housing assemblies to enable said outlets to have variable entrance coefficients.

10. The radial diffuser as recited in claim 8 wherein said first insert ring and said second insert ring being disposed opposite each other to create a microturbulence within said chamber.

11. The radial diffuser as recited in claim 8 wherein said first predetermined surface and said second predetermined surface comprises a fixed or a variable restrictor surface.

12. The radial diffuser as recited in claim 8 wherein:

said outlets connect to a tube having a ninety degree curvature; and said tube comprises a dilution line means for providing controlled fluid flow to a forming unit.

13. A method of providing a radial diffuser comprises the steps of:

providing a main body having a chamber for receiving and dispersing a fluid stock suspension;

forming an inlet for connection to a source of said fluid stock suspension in the center of said main body;

arranging a plurality of outlets in uniformly spaced relationship around a side wall of said main body;

positioning said outlets at substantially right angles to the direction of flow of said entering fluid stock suspension;

attaching a cover having a flat area for impacting of said fluid stock suspension securely to said main body; and positioning a means having a predetermined surface within said radial diffuser for enhancing said fluid stock suspension flow after impacting said cover, said predetermined surface means includes an insert ring within a circular channel of said cover.

14. The method as recited in claim 13 wherein said step of providing a plurality of said outlets comprises the step of providing said outlets in removable housing assemblies to enable said outlets to have variable entrance coefficients.

15. The method as recited in claim 13 wherein said step of positioning said means having a predetermined surface comprises the step of providing an insert ring within a circular channel of said main body opposite said circular channel of said cover.

16. A method of providing microturbulence to a fluid stock suspension in a radial diffuser comprising the steps of:

providing a main body having a chamber in said radial diffuser for receiving and dispersing said fluid stock suspension;

forming an inlet for connection to a source of said fluid stock suspension in the center of said main body;

arranging a plurality of outlets in uniformly spaced relationship around a side wall of said main body;

providing said outlets at substantially right angles to the direction of flow of said entering fluid stock suspension;

attaching a cover securely to said main body;

disposing in said cover a first insert ring having a first variable restrictor surface to enhance the flow of said fluid stock suspension;

disposing in said main body a second insert ring having a second variable restrictor surface to enhance the flow of said fluid stock suspension; and supplying said fluid stock suspension to said radial diffuser to flow over said first variable restrictor surface and said second variable restrictor surface to achieve said microturbulence of said fluid stock suspension.

17. The method as recited in claim 16 wherein said step of providing a plurality of said outlets comprises the step of providing said outlets in removable housing assemblies to enable said outlets to have variable entrance coefficients.

18. The method as recited in claim 16 wherein said method comprises the steps of:

connecting a tube having a ninety degree curvature to each of said outlets; and feeding a dilution line means into said tube to provide controlled fluid control to a forming unit.

* * * * *